United States Patent [19]

Tanca

[11] 4,333,742

[45] Jun. 8, 1982

[54] SOOT BLOWER USING FUEL GAS AS BLOWING MEDIUM

[75] Inventor: Michael C. Tanca, Tariffville, Conn.

[73] Assignee: Combustion Engineering, Inc., Windsor, Conn.

[21] Appl. No.: 240,427

[22] Filed: Mar. 4, 1981

[51] Int. Cl.[3] ..... C10J 3/86

[52] U.S. Cl. ..... 48/77; 48/87; 15/316 R; 122/390

[58] Field of Search ..... 48/77, 87; 122/390, 122/391, 392; 15/316 R; 165/95

[56] References Cited

U.S. PATENT DOCUMENTS

| | | | |
|---|---|---|---|
| 4,018,242 | 4/1977 | Jaschinski et al. | 165/95 |
| 4,093,242 | 6/1978 | Terry | 122/392 |
| 4,207,648 | 6/1980 | Sullivan et al. | 15/316 R |

*Primary Examiner*—William F. Smith
*Attorney, Agent, or Firm*—William W. Habelt

[57] ABSTRACT

A soot blower assembly (10) for use in combination with a coal gasifier (14). The soot blower assembly is adapted for use in the hot combustible product gas generated in the gasifier as the blowing medium. The soot blower lance (20) and the drive means (30) by which it is moved into and out of the gasifier is housed in a gas tight enclosure (40) which completely surrounds the combination. The interior of the enclosure (40) is pressurized by an inert gas to a pressure level higher than that present in the gasifier so that any combustible product gas leaking from the soot blower lance (20) is forced into the gasifier rather than accumulating within the enclosure.

2 Claims, 2 Drawing Figures

SOOT BLOWER USING FUEL GAS AS BLOWING MEDIUM

BACKGROUND OF THE INVENTION

The present invention relates to soot blowers for dislodging ash accumulations from the convection surfaces of heat exchangers, and more particularly, a soot blower adapted for cleaning the convection surfaces of heat exchangers disposed in a coal gasifier by using the combustible product fuel gas as the soot blowing fluid.

Soot blowers have been used for years to clean ash deposits from the convection surfaces of heat exchangers of coal-fired steam generators. Typically, these prior art soot blowers comprise an elongated lance operatively associated with a motor so that the lance may be translated for long distances into the furnace of the steam generator so as to reach the heat exchange surface disposed therein. A cleaning fluid passes into the lance at a location outside of the furnace, traverses the lance, and is discharged through holes in the discharge end of the lance or through a nozzle attached thereto.

A number of cleaning fluids, such as air, steam, water, or flue gas, have been utilized in these conventional soot blowers. These fluids have proven quite satisfactory for use in dislodging ash from heat exchange tube bundles disposed in coal-fired furnaces. However, a significant problem exists when these aforementioned cleaning fluids are used for dislodging ash deposits from the heat exchange surface of tube bundles disposed in a coal gasifier. The problem being that these fluids all tend to dilute the combustible product fuel gas formed in the coal gasifier thereby lowering its heating value.

One solution to this problem is disclosed and claimed in my co-pending application Ser. No. 175,999, filed Aug. 7, 1980. As proposed therein, combustible product fuel gas is used as the blowing medium. In this way, the fuel gas formed in the coal gasifier is not diluted by the soot blowing fluid used to clean ash deposits from the heat exchange surface disposed within the gasifier.

However, the conventional prior art soot blowers are not satisfactory for use with combustible product fuel gas as the soot blowing medium. The conventional soot blowers of the prior art tend to suffer from severe leakage around various seals which must be incorporated into their design in order to permit the lance to be translated into and out of the gasifier in order to obtain access to the heat exchange surface disposed therein. If air or steam or flue gas are used as the soot blowing medium, such leakage should not create any serious problems. However, when combustible product fuel gas is used, such leakage presents the serious problem that an explosion could very well occur due to the combustible nature of the soot blowing fluid.

SUMMARY OF THE INVENTION

Therefore, the present invention contemplates a soot blower design adapted for use on a coal gasifier with the combustible product fuel gas of the coal gasifier being used as the soot blowing fluid. In accordance with the present invention, the soot blower lance and the motor means by which it is moved into and out of the gasifier is housed in a gas tight enclosure which completely surrounds the combination. The enclosure has one open end mounted to the wall of the coal gasifier about an axis opening therein through which the discharge end of the soot blower lance passes to gain access to the heat exchange surface disposed within the gasifier. Additionally, inert gas supply means are provided for injecting inert gas into the gas tight enclosure so as to maintain the gas pressure within the gas tight enclosure higher than the gas pressure within the gasifier thereby ensuring that there will be no leakage of fuel gas from the gasifier through the access opening in the wall of the gasifier and to ensure that any flue gas leakage from the soot blower per se will be forced into the gasifier.

DETAILED DESCRIPTION OF A PREFERRED EMBODIMENT

Figure 1:
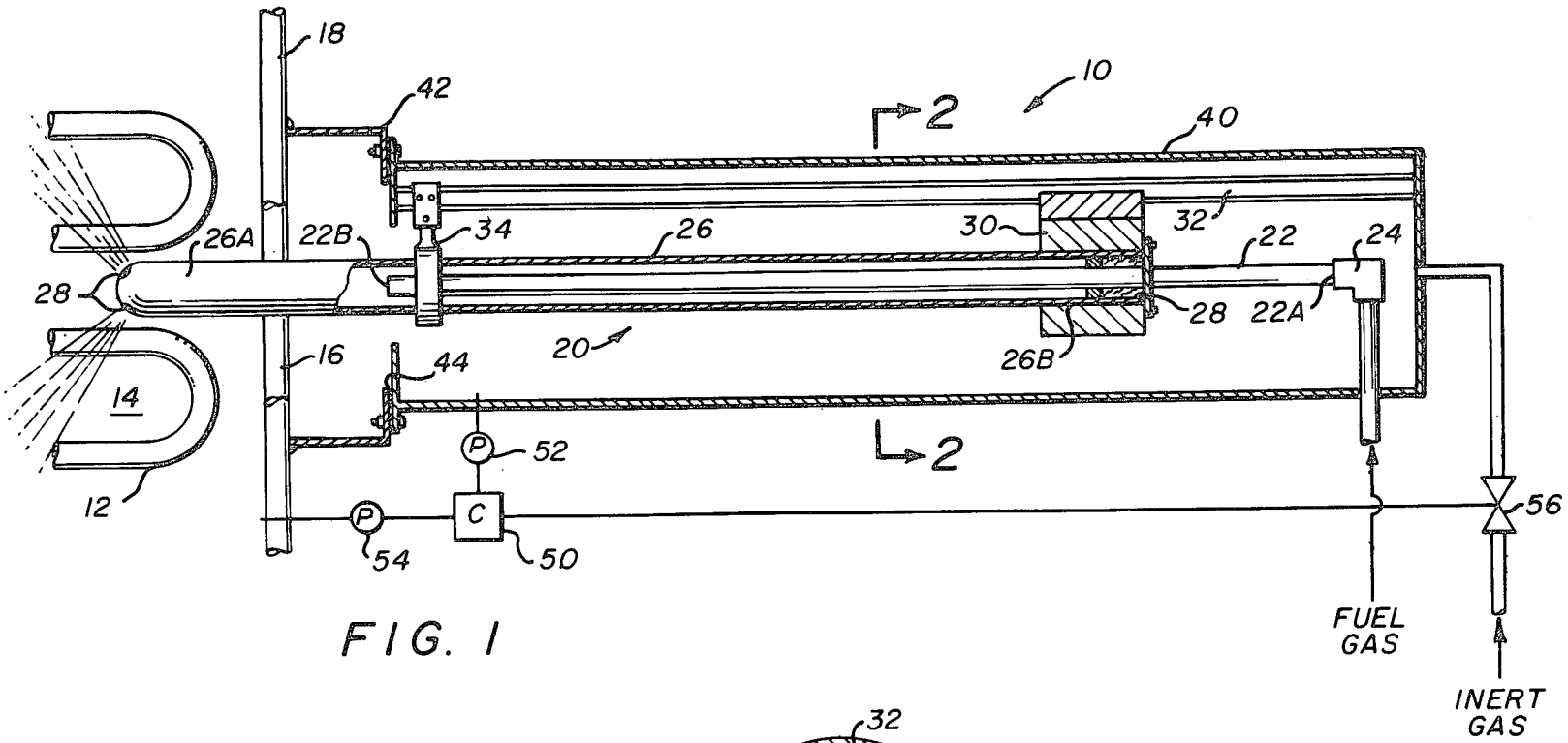
FIG. 1 is a partly diagrammatic side elevational view of the soot blower assembly of the present invention.

There is depicted in the drawing a soot blower assembly 10 designed in accordance with the present invention and adapted for cleaning ash deposits from heat exchange surface 12 disposed within the coal gasifier 14. The soot blower lance is adapted to be projectable into and retractable from the interior of the coal gasifier 14 through an access opening 16 in the wall 18 thereof. The soot blower lance may also be rotated or oscillated about its longitudinal axis while translating into and out of the interior of the coal gasifier to further facilitate cleaning of the heat exchange surface 12. To dislodge ash deposits from the heat exchange surface 12, combustible product fuel gas from the coal gasifier outlet is passed through the soot blower lance and discharged therefrom so as to impinge upon the heat exchange surface 12. The soot blower lance 20 comprises an elongated inner feed tube 22 having an open outlet end 22B and an inlet end 22A connected to a valve 24. An elongated outer tube 26 is disposed in concentric space relationship about the inner feed tube 22 and is longitudinally movable with respect to the inner feed tube 22. The outer tube 26 is adapted to receive the soot blowing fluid passing from the outlet 22B of the inner feed tube 22 and a discharge end 26A through which the combustible product gas passes into the furnace. A plurality of holes 28 may be provided in the discharge end 26A so that the soot blowing fluid may be directed into the furnace so as to impinge upon the heat exchange surface. Alternately, a special spray nozzle may be attached to the discharge end 26A of the outer tube 26. The outer tube 26 of the soot blower lance 20 is mounted to motorize drive means 30 which is suspended from beam 32 by means of roller supports. Typically, the outer tube 26 is also slidably mounted within an end support 34 also suspended from the beam 32. To translate the soot blower lance 20 into and out of the furnace, motorize drive means 30 is actuated to move along the support beam 32.

When the valve 24 is opened, soot blowing fluid passes therethrough into the inner feed tube 22, thence into the outer tube 26, and thence discharges therefrom through openings 28 so as to impinge against the heat exchange surface 12 within the gasifier 14. As the outer tube 26 is translatable along the inner tube 22, a slidable sealing packing 28 is provided at the support end 26B of the outer tube in the annular space between the outer tube 26 and the inner tube 22. However, because the outer tube 26 must be freely movable along the inner tube 22, leakage of the soot blowing fluid out of the soot blower lance 20 cannot be completely eliminated.

As discussed previously, it is highly desirable to use the combustible product fuel gas formed in the gasifier as the soot blowing fluid in order to preserve the heating value of the fuel gas produced in the coal gasifier. Therefore, provision must be made to accommodate the leakage of this combustible fuel gas from the soot blower lance 20. According to the present invention, there is provided a gas tight enclosure 40 which surrounds the combination of the soot blower lance 20 and the motorized drive means 30. Thus, any fuel gas leaking from the soot blower lance 20 will be captured within the interior of the gas tight enclosure 40. To prevent accumulation of the combustible, and therefore explosive, fuel gas within the enclosure 40, inert gas is pumped into the interior of the enclosure 20 at a pressure higher than that within the coal gasifier 14. Therefore, any fuel gas leaking from the soot blower lance 20 will be forced into the gasifier chamber 14 rather than accumulating within the enclosure 40.

Figure 2:
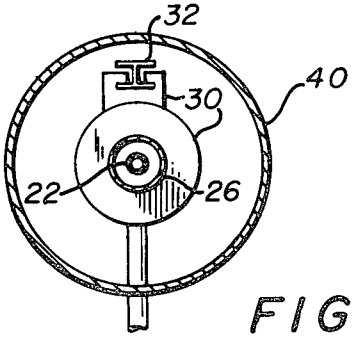
FIG. 2 is a cross-sectional view taken along line 2—2 of FIG. 1 of the soot blower assembly of the present invention.

As is shown in FIGS. 1 and 2, the support beam 32 is preferably also housed completely within the gas tight enclosure 40. Although the gas tight enclosure 40 may be mounted directly to a gasifier wall, it is preferable that the enclosure 40 be removably mounted to wall box 42 which itself is permanently mounted to the wall of the gasifier. A sealed gasket 44 would, of course, be provided between the enclosure 40 and the wall box 42.

In accordance with the invention, the pressure within the gas tight enclosure 40 is maintained above that within the gasifier 14 by supplying inert gas to the interior of the enclosure 40. A controller 50 receives a signal from pressure sensor 52 which is indicative of the gas pressure within the gas tight enclosure 40 and an additional signal from pressure sensor 54 which is indicative of the gas pressure within the coal gasifier 14. The controller 50 then compares the two pressure signals and opens valve 56 to allow the flow if inert gas into the interior of gas tight enclosure 40 so as to maintain the gas pressure within the gas tight enclosure 40 in excess of the gas pressure within the coal gasifier 14. By maintaining the gas pressure within the gas tight enclosure 40 above that within the gasifier 14, the back flow of combustible fuel gas from the gasifier 14 into the interior of the gas tight enclosure 40 surrounding the soot blower is prevented. Additionally, the maintenance of a higher gas pressure within the gas tight enclosure 40 establishes flow from the gas tight enclosure 40 into the coal gasifier 14 thereby ensuring that any leakage of fuel gas from the soot blower lance 20 will be vented into the coal gasifier. Further, the presence of inert gas within the gas tight enclosure 40 would prevent the occurrence of an explosion from any fuel gas leaking from the soot blower lance 20 and accumulating within the gas tight enclosure 40.

Although the present invention has been described in relation to a soot blower lance formed of an outer tube surrounding and longitudinally movable with respect to an inner tube, it will be appreciated that modifications of the soot blower lance may be readily made thereto by those skilled in the art while still not departing from the spirit and scope of the invention which lies in the provision of an inerted gas tight enclosure surrounding the soot blower lance; therefore, it is intended by the appended claims to cover all modifications which fall within the true spirit and scope of the invention as defined in the appended claims.

I claim:

1. In combination with a coal gasifier having a furnace defined by a bounding wall wherein coal is gasified to generate a hot combustible product gas, and having at least one heat exchange tube bundle disposed within the furnace so that the hot combustible product gas must traverse the tube bundle before leaving the furnace, a soot blower assembly comprising:

a. a soot blower lance having an inlet end for receiving the hot combustible product gas and a discharge end through which the hot combustible product gas is directed into the furnace so as to impinge upon the tube bundle, the discharge end of said lance being translatable into and out of said furance;

b. drive means operatively associated with said soot blower lance for moving the discharge end of said lance into and out of said furnace;

c. a gas tight enclosure surrounding the combination of said soot blower lance and said drive means, said enclosure having one open end mounted to the furnace about an access opening in the wall of the furnace through which the discharge end of said soot blower lance passes to gain access to the heat exchange tube bundle disposed within the furnace; and d. supply means for injecting inert gas into said gas tight enclosure so as to maintain the gas pressure within said gas tight enclosure higher than the gas pressure within the furnace.

2. A soot blower assembly as recited in claim 1 wherein said soot blower lance comprises:

a. an elongated feed tube having an open outlet end and an inlet end through which combustible product gas is allowed to flow into and thence through said feed tube; and b. an elongated outer tube having an open end for receiving the combustible product gas from said feed tube and a discharge end through which the combustible product gas is directed into the furnace so as to impinge upon the heat exchange tube bundle, said elongated outer tube disposed in concentric spaced relation with and longitudinally movable with respect to said feed tube, said outer tube being operatively associated with said drive means.

* * * * *